United States Patent [19]

Tyler, Jr.

[11] 4,136,610

[45] Jan. 30, 1979

[54] PORTABLE BALE PRESS

[75] Inventor: William R. Tyler, Jr., Lexington, Ky.

[73] Assignee: Brown & Williamson Tobacco Corporation, Louisville, Ky.

[21] Appl. No.: 832,625

[22] Filed: Sep. 12, 1977

[51] Int. Cl.[2] ..... B30B 15/32

[52] U.S. Cl. ..... 100/100; 100/3; 100/218; 100/226; 100/255

[58] Field of Search ..... 100/100, 255, 226, 229 R, 100/218, 228, 240, 246, 7, 3

[56] References Cited

U.S. PATENT DOCUMENTS

| | | | |
|---|---|---|---|
| 3,211,085 | 10/1965 | Zeppetello | 100/226 X |
| 3,728,959 | 4/1973 | Fredrickson | 100/255 X |

FOREIGN PATENT DOCUMENTS

| | | | |
|---|---|---|---|
| 223602 | 3/1959 | Australia | 100/100 |

*Primary Examiner*—Billy J. Wilhite

*Attorney, Agent, or Firm*—William J. Mason; Charles G. Lamb

[57] ABSTRACT

A portable bale press for tobacco and the like. The press includes a wheeled support and a compression chamber on a pivotable frame on the support. A press head attached to the rod of a hydraulic cylinder is also on the frame and is movable into the compression chamber to form a compressed mass of tobacco in the compression chamber. Power is supplied for driving the press head. The pivotable frame which supports the compression chamber, hydraulic cylinder and press head and is shiftable between an inactive position for transportation of the bale press and an active position where the compression chamber of the press is in position for compression of tobacco. Releasable holding and shifting structure is provided for transferring the frame between positions and holding the frame in the active and inactive positions for tobacco compression and transportation of the bale press respectively.

18 Claims, 7 Drawing Figures

PORTABLE BALE PRESS

BACKGROUND OF THE INVENTION

Traditionally the tobacco farmer has had to cope with handling loose leaf tobacco or bundles of tobacco after the curing process. In certain areas, it would be advantageous for him to be able to form bales for more efficient handling and shipping. Leaf and strip tobacco can be conveniently compressed into cubical bales with bale boards on two ends and plastic or steel strapping applied to hold the bale in the compressed condition. Conveniently cubical bales are formed which facilitates handling particularly when mechanical lift equipment is employed. Furthermore, the cubical bales can be easily stacked for storage to most effectively utilize available space. The difficulty with the best known tobacco baling procedures is that the baling mechanisms are quite cumbersome, large and expensive and are fixed at a location that is usually quite remote from the fields where the tobacco is grown.

Therefore, it would certainly be advantageous to provide an inexpensive and easy to operate bale press which is portable and can be readily transported to the fields. In this manner, the tobacco can be easily handled at an early stage of harvesting and processing. Naturally, the advantages of the fixed equipment are desired in adapting the equipment for portable use. The difficulty of transportation and use of the bale press must be maintained at a minimum so that the advantages of portability and baling procedures are maintained. Also, low initial cost is a factor in connection with the equipment utilized as well as operating cost and efficiency.

Throughout the years, more specifically for the past 100 years, various types of baling presses have been developed with the sophistication of the machinery being influenced by changing technology. The presses have been used in handling and processing materials such as cotton, hops and tobacco.

Examples of early presses developed in the 19th century appear in U.S. Pat. Nos. 151,594; 155,329; 172,132; 177,547; 214,838; 224,924; 261,855; 230,053; 266,718 and 335,053.

At the turn of the century, more sophisticated types of improved machinery produced somewhat more complex baling presses such as those in U.S. Pat. Nos. 670,505; 867,142; 1,132,083; and 1,260,162.

Thereafter, during the first half of the present century, in view of the development of the motor vehicle and other sophisticated power devices, various types of powered presses were engineered such as those in U.S. Pat. Nos. 2,265,771; 2,476,672; 2,579,176; 2,782,710; and 2,816,502.

Finally, more recent sophisticated processing equipment and procedures have been developed building upon the previous technology, as examplified by U.S. Pat. Nos. 3,561,191; 3,768,679; 3,824,758; and 3,828,662.

Tracing the development of the baling press, and more specifically a portable baling press throughout the past 100 years, as can be observed from the above mentioned patents, shows the rate of development as well as the apparent understanding of the need for more effective ways of handling material such as tobacco. Further improvements are constantly being sought to enhance the efficiency of handling tobacco.

SUMMARY OF THE INVENTION

With the above background in mind, it is among the primary objectives of the present invention to provide an improved portable bale press which can be quickly and efficiently transported to a field where material such as tobacco has been harvested and cured and then be quickly and efficiently set up for baling operations. When the baling operation is complete, the press can again be rapidly and efficiently returned to the inactive position and transported to another location for reuse in a baling operation.

The bale press is designed to make use of modern and effective bale press machinery which is mounted and held in position for transporation and can be easily shifted and held in position for operation of the bale press at a remote location. The apparatus is designed for use with a convenient power source such as a tractor transporting the bale press between locations. The support structure for the bale press contains wheels to permit handling of the bale press by the tractor.

An objective is to provide a bale press which is shiftable between a horizontal position for transportation and storing and a vertical position for operation. The bale press is incorporated into a frame which is pivotable between horizontal and vertical positions. When vertical, the bale press rests in fixed position on the ground.

The press contains a pivotable frame supporting a hydraulic cylinder, a press head and compression chamber in an inactive horizontal position during transportation. A winch is on the wheeled support and is connected to the frame to facilitate the shifting of the frame between the active vertical and the inactive horizontal positions. Appropriate jacks are provided on the trailer structure to lift the wheels of the trailer from the ground and permit pivoting or rotation of the frame, including the compression chamber, into the vertical position to rest on the ground. A removable stop is provided on the support in engagement with the rearward end of the frame containing the compression chamber so that when the stop is removed the frame can pivot from the horizontal to the vertical position. The winch cable can be freely unreeled when the stop is removed and the shiftable portion of the bale press, that is the frame, hydraulic cylinder, press head and compression chamber are weighted so that gravity causes them to rotate about the pivot into the vertical position with the press head on top and the compression chamber on the ground. Reeling of the winch cable causes rotation of the frame, hydraulic cylinder, press head and compression chamber in the opposite direction and back into the inactive horizontal position for transportation or storage.

A hydraulic pump is provided on the press and is interconnected with the hydraulic cylinder of the press to operate the press when the pump is powered. The pump is adapted for connection directly to the power take off shaft of a tractor used for pulling the bale press. This is accomplished with the assistance of a telescoping drive shaft between the pump and the power take off shaft of the tractor.

The structure forming the compression chamber is provided with a plurality of apertures to permit the access of mechanical lift equipment to engage with the completed bale and remove it from the compression chamber after the baling operation has been completed.

A hinged door is provided in the compression chamber to be opened for removal of each bale as it is completed.

In summary, a portable bale press for tobacco and the like is provided including a wheeled support and a frame with compression chamber, hydraulic cylinder and press head. The press head is movable into the compression chamber to form a compressed mass of tobacco in the compression chamber. Power means is on the press for driving the press head. A movable frame supporting the compression chamber, hydraulic cylinder and the press head is on the support and is shiftable between an inactive position for transportation of the bale press and an active position when the compression chamber and the press head are in position for compression of tobacco. Releasable holding and shifting means is provided for transferring the frame between positions and holding the frame in the active and inactive positions for tobacco compression and transportation of the bale press respectively.

With the above objectives among others in mind, reference is made to the attached drawing.

DETAILED DESCRIPTION

Figure 1:
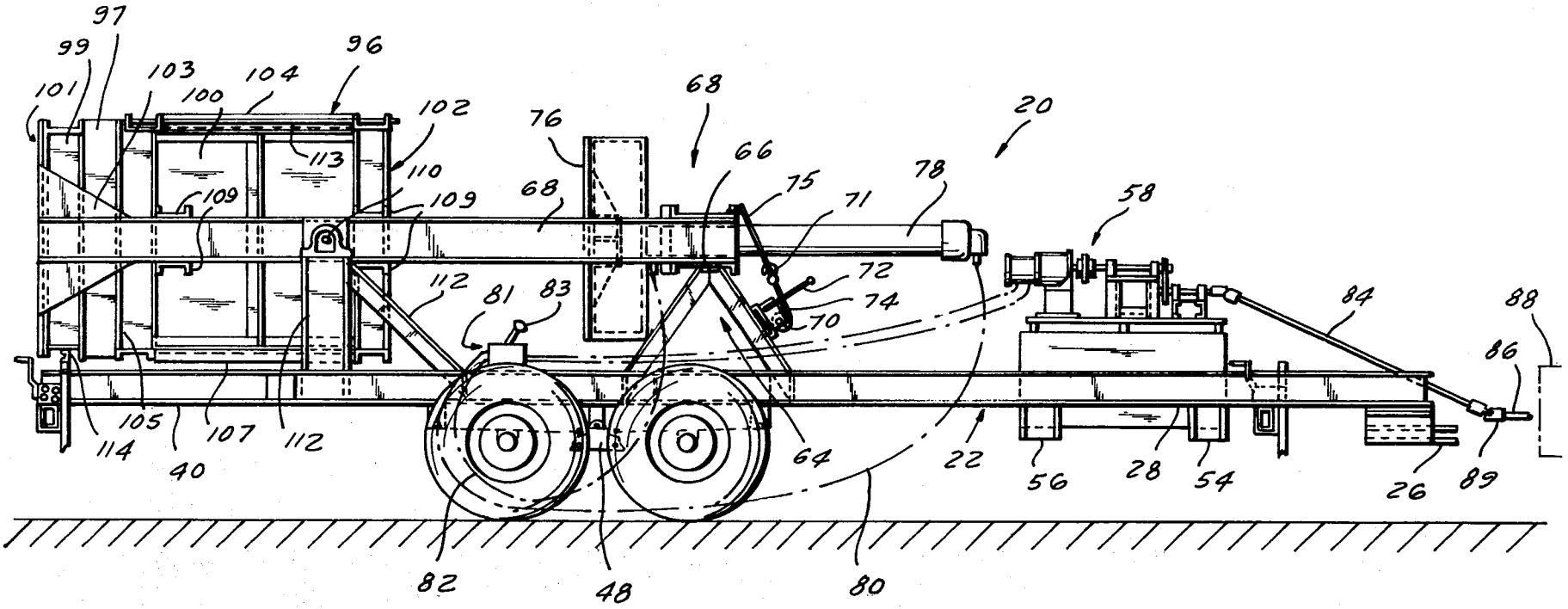
FIG. 1 is a side elevation view of the bale press of the invention.

Bale press 20 is designed with a support base 22 the forward end of which tapers to a narrow diameter front end 24. A conventional trailer hitch 26 extends from front end 24 for coupling with a tractor 88 or then conventional drive vehicle.

The frame of the support 22 tapers outwardly from forward end 24 by means of a pair of outwardly extending side wall portions 28 and 30 which extend into two opposed parallel central side wall portions 32 and 34. Portions 32 and 34 extend into two short outward extensions 36 and 38 respectively which conclude with two parallel rear end side wall portions 40 and 42 respectively. Portions 40 and 42 terminate at the rear open end 44 of the trailer.

Two sets of wheels 46 are mounted to the under carriage of support 22 at the location of central side wall 34 and 32. The wheels are mounted on shafts journaled in depending wheel housing 48 of the support. In this manner, when the support is attached to a tractor the wheels will permit the support to be rolled behind the tractor as it advances.

A number of transverse supporting members are mounted to the opposed side walls of support 22 along the length of the bale press 20. Adjacent to forward end 24 is transverse support member 50 which forms a support for a conventional jack 52 mounted thereon in a convenient and well known manner.

In the rearward direction are two spaced transverse supports 54 and 56 on which is mounted hydraulic pump assembly 58.

In the rearward direction, the next transverse supports 60 and 62 in the central portion of the press extend upwardly and inwardly to form a V-shaped support or platform 64. The upper surface 66 of the V-shaped platform 64 forms a resting surface for press frame 68 when the press is in the horizontal and inactive position for transportation. A winch 70 is mounted on bracket 60 above the surface of the support 22. A conventional type of winch such as a 2500 pound lift capacity manual boat winch marketed by Sears, Roebuck and Company as Catalog No. 6K62421C has been found to work effectively. The winch handle 72 extends upwardly and outwardly for ease of access and operation of the winch. The winch cable 74 is connected to the press frame 68. The connection is made by attaching hook 71 on the end of cable 74 to loop cable 75 anchored to press frame 68.

Figure 2:
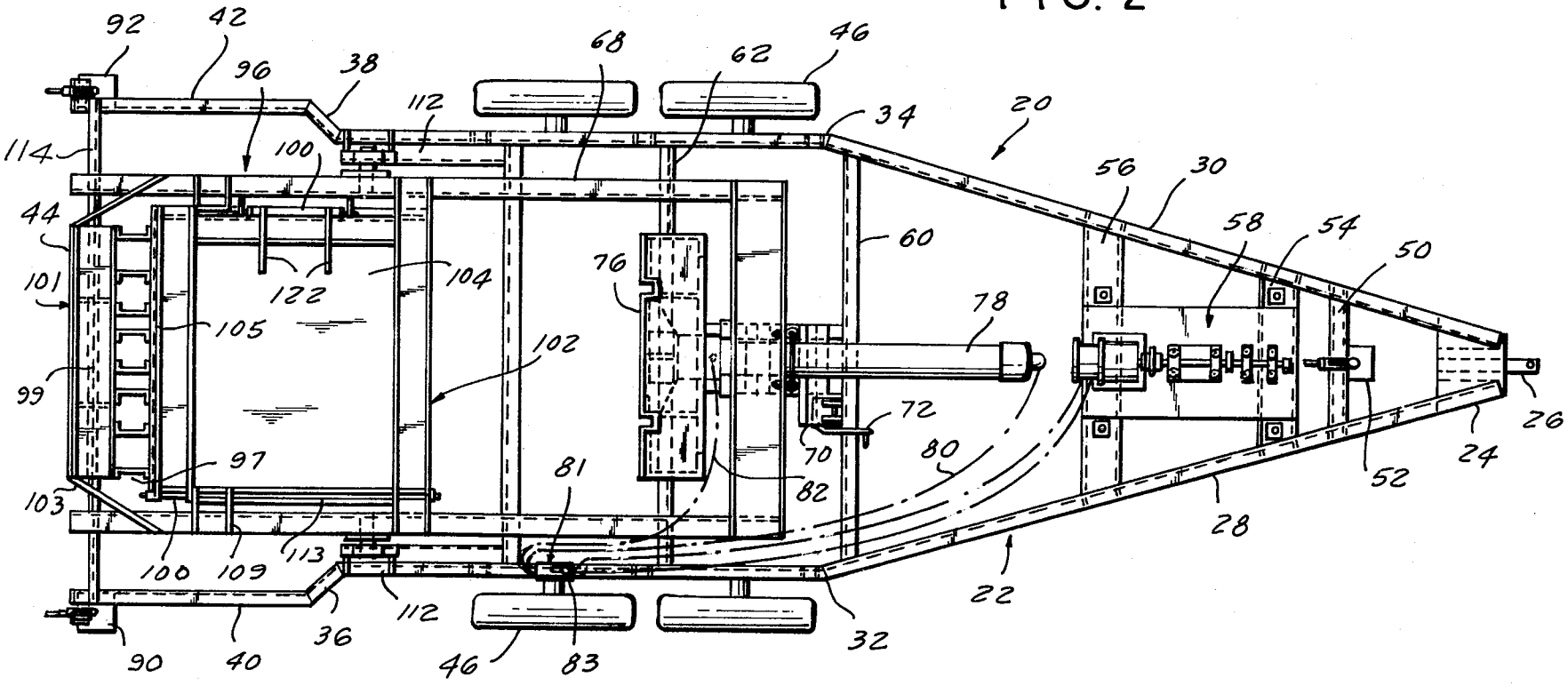
FIG. 2 is a top plan view thereof.
Figure 3:
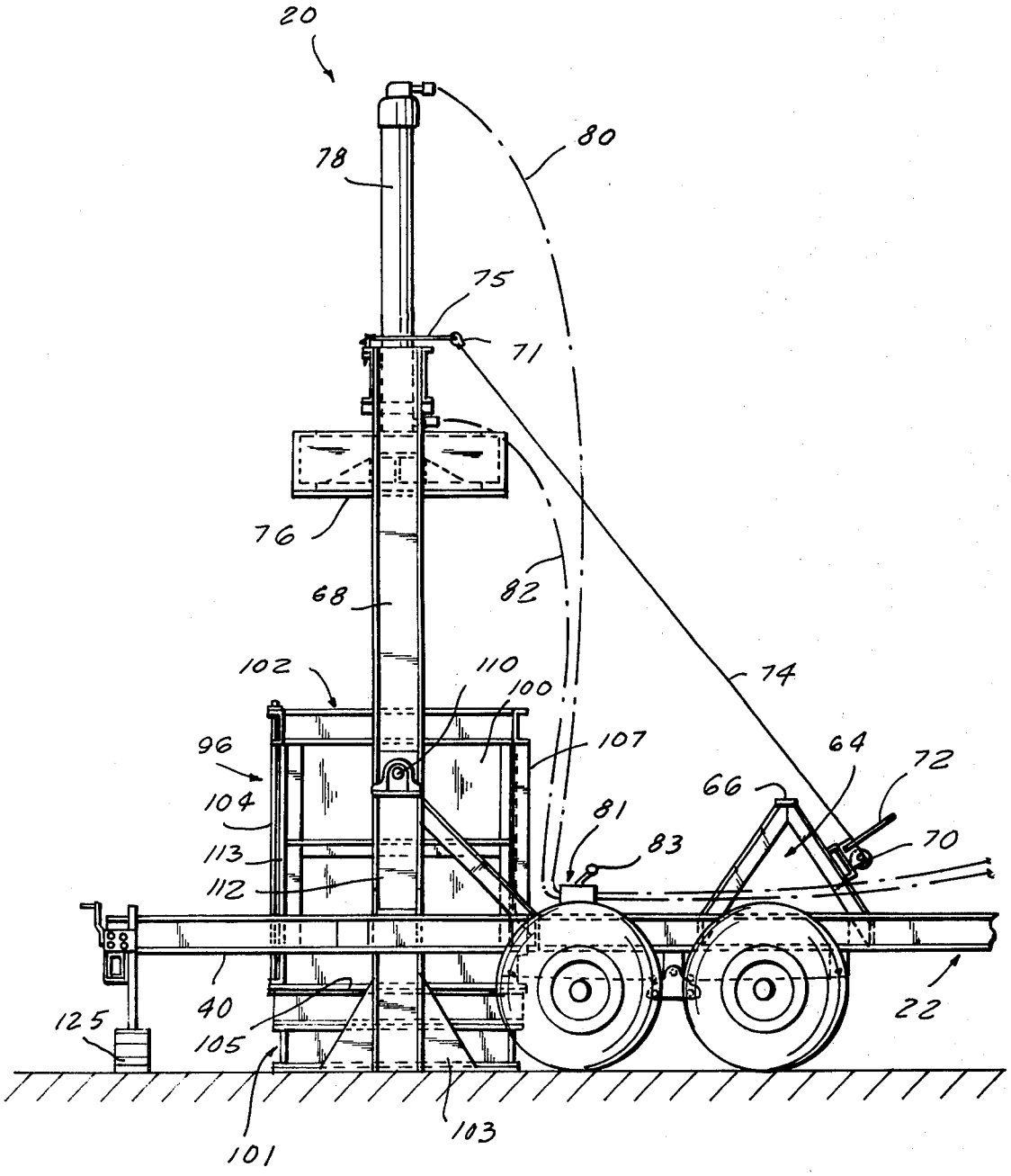
FIG. 3 is a fragmentary side elevation view thereof with the bale press having been shifted to the active and operational position.
Figure 4:
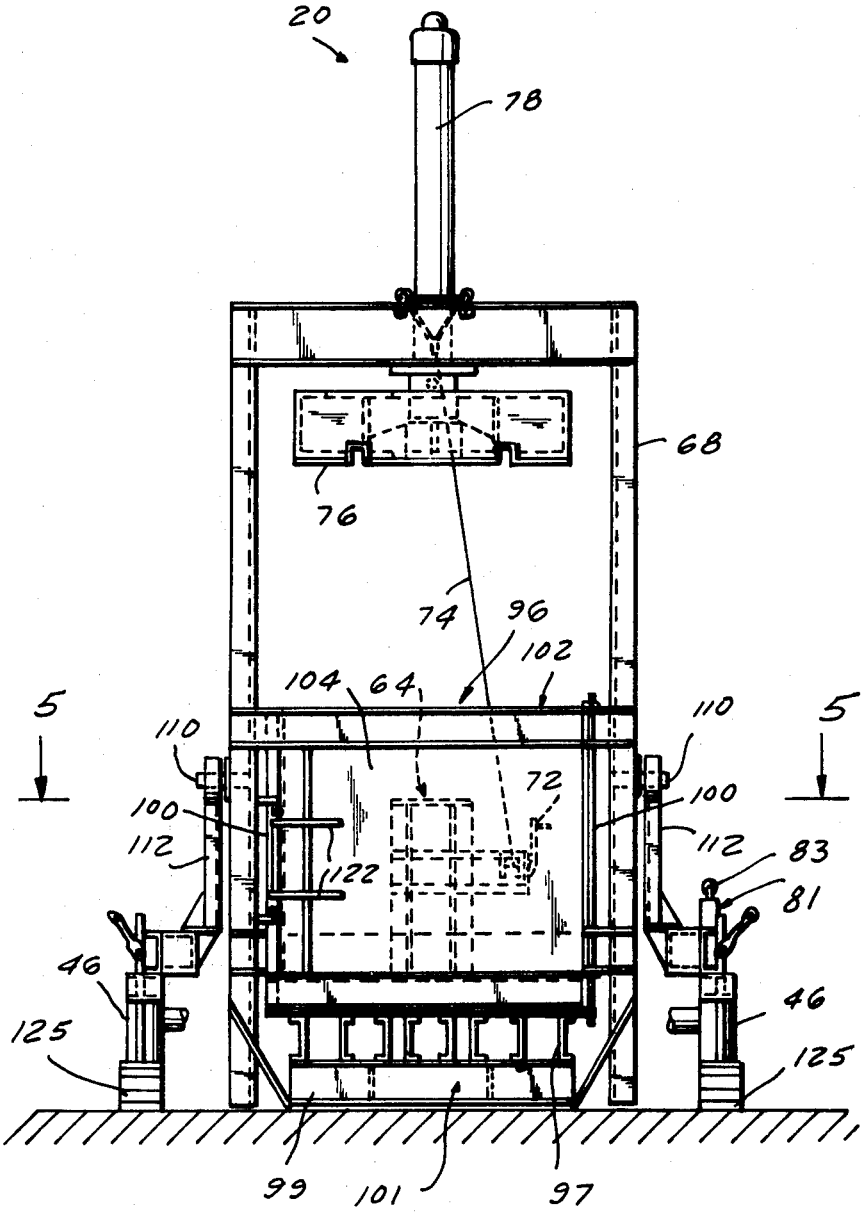
FIG. 4 is an enlarged end elevation view thereof taken along the plane of line 4—4 of FIG. 3.

As shown in FIGS. 1 and 2 the press head 76 is in the horizontal inactive position and the hydraulic cylinder 78 extends forwardly therefrom. Hydraulic cylinder 78 is connected by means of flexible hydraulic hoses 80 and 82 in a conventional manner to the hydraulic pump assembly 58. A conventional type of directional control valve 81, usually operated by lever 83, is positioned intermediate the ends of hoses 80 and 82 for operation of the press. The valve 81 is mounted on the support 22. An appropriate hydraulic pump unit and oil reservoir tank of a conventional nature are included in the pump assembly 58.

Extending forwardly from the pump assembly 58 is a telescoping drive shaft 84 which is connected directly to the power take off shaft 86 of a tractor 88 by pivot point 89.

Jack 52 along with two additional similar jacks 90 and 92 mounted adjacent the rear open end 44 of the support are conventional such as 24" lift dolly-jacks sold by Sears, Roebuck and Company under Catalog No. 6K62424C. The depicted jacks are manual with jack handles to operate the jacks in lifting the press from the ground and returning it to the ground.

Figure 7:
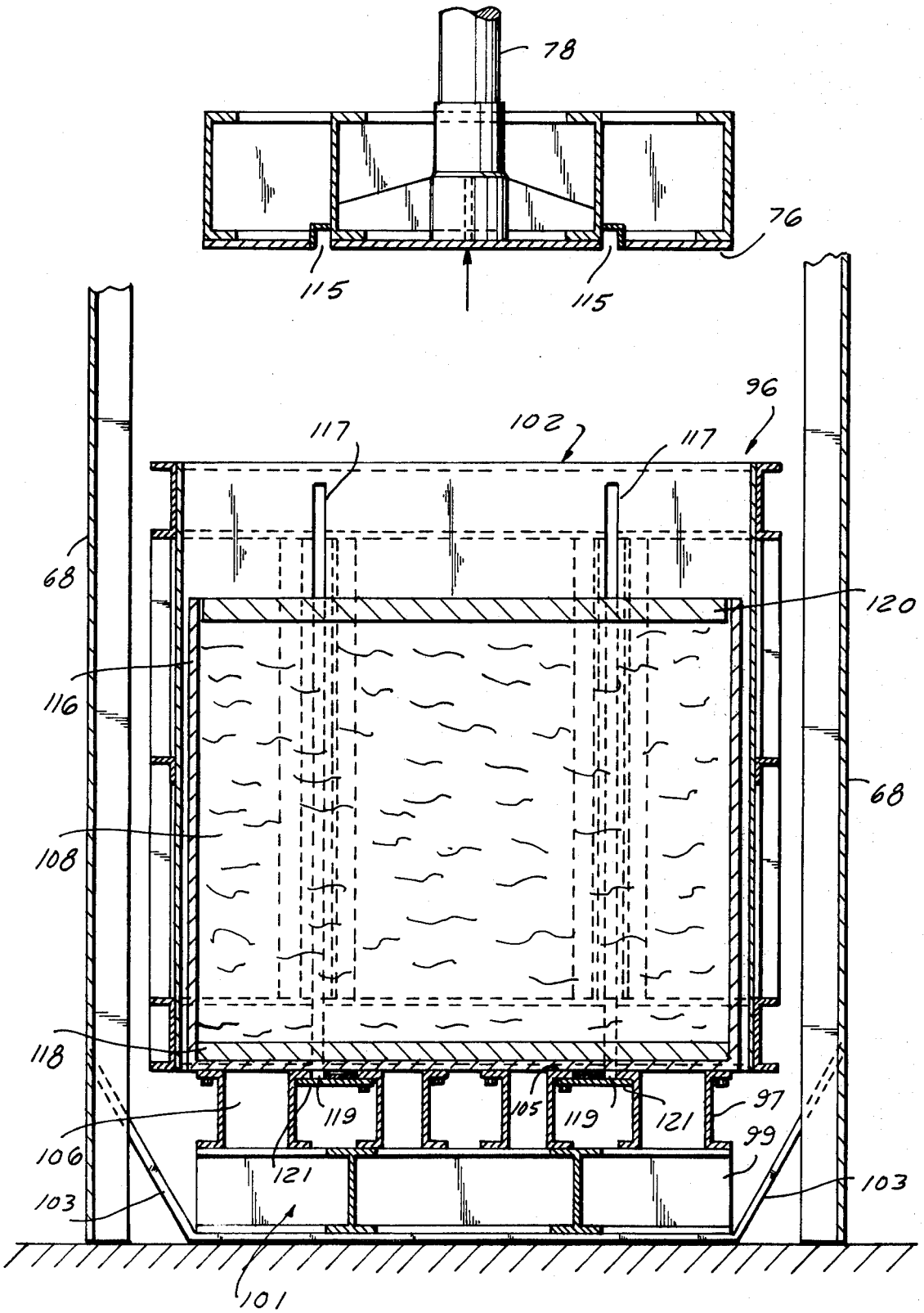
FIG. 7 is a sectional elevation view thereof taken along the plane of line 7—7 of FIG. 5 and showing the press head removed in the vertical direction after formation of a bale in the compression chamber.

The frame 68 on which hydraulic cylinder 78 is mounted in a conventional manner for reciprocal movement under the power of hydraulic pump assembly 58 also has mounted on the other end thereof a compression chamber 96. The hollow compression chamber 96 has a base structure 101 formed of an arrangement of interconnected channel beams supported by sling 103. The channel beams are arranged in two layers with the upper layer 97 having its beams perpendicular to the beams of lower layer 99. The lower layer rests on a rigid sling 103 portion and the upper layer forms the base 105 for the chamber 96. Chamber 96 has a pair of opposing side walls 100, a rear wall 107, and a front door 104 formed in a cubical arrangement. The chamber 96 has an open upper end 102 for introduction of tobacco and also introduction and removal of the press head 76. Door 104 can be opened to permit access to a bale formed therein for removal thereof. Similarly, the base wall 105 of base structure 101 is provided with open channels 106 between the beams as depicted in FIG. 7, to permit access of a conventional removing device such as a mechanical lift to a bale 108 formed in chamber 96.

Each side wall 100 is mounted to frame 68 by use of four pairs of spaced channel brackets 109. The side walls are welded to rear wall 107 which in turn is bolted to the channel beams of layer 97 by the use of bolts 111. The door 104 is mounted to the side wall 100 by the use of conventional hinge assembly 113 on one side and latch assembly 122 on the other side.

Frame 68 with the hydraulic cylinder 78 and compression chamber 96 mounted thereon is pivotally mounted on two opposing shafts 110 journaled on upwardly extending opposing arms 112 from support 22. In this manner, the frame and mounted components can be pivoted about shafts 110 and shifted from the horizontal position as depicted in FIGS. 1 and 2 to the vertical position as depicted in FIGS. 3–7 for use.

To retain frame 68 and mounted components in the horizontal position a removable elongated, U-channel member 114 is engaged with the upper rear end of support 22 and the undersurface of the end of pivotal frame 68 containing the compression chamber. The weight distribution on frame 68 including the press head 76, hydraulic cylinder 78 and the compression chamber 96 is such that, when channel 114 is removed, the frame 68 will tend to pivot into the vertical direction unreeling winch cable 74 of which 70.

As particularly shown in FIG. 7, strapping slots 115 are provided in the base of press head 76 which mate with strapping slots 117 in the rear wall 107 when positioned adjacent thereto. In turn, strapping slots 119 are provided in the upper layer 97 of channel beams to mate with slots 117. In this manner, strappings can be applied to a bale when door 104 is in the open position. A plate assembly 121 is bolted to the channeled beams in upper layer 97 to retain the straps in slots 119.

In operation, when the bale press 20 is to be taken into the fields, tractor 88 is connected to hitch 26. The frame 68 and components mounted thereon are maintained in horizontal position by means of stop channel 114. In this position, winch cable 74 is reeled onto winch 70. The hydraulic cylinder 78 on press frame 68 is connected by means of hoses 80 and 82 to the pump of hydraulic pump assembly 58. Jacks 52, 90 and 92 are retracted so that wheels 46 form the base for the support. The press 20 is then pulled by the tractor to the fields where the product such as tobacco has been harvested and cured. When the desired location has been reached, the tractor is stopped and is connected by attaching shaft 86 with telescoping shaft 84 on the press 20. Jacks 52, 90 and 92 are then manually activated to lift trailer frame 22 the desired distance off the ground. This provides a new support for the bale press in fixed stationary position with wheels 46 off the ground. The bale press 20 is then at a fixed horizontal supported position.

Stop channel 114 is removed and, due to the weight distribution, under the force of gravity frame 68 will pivot about shafts 110 into the vertical position with the press head 76 above the open end 102 of compression chamber 96. The winch acts as a brake and a controlled unreeling of the winch limits the speed of rotation. Hoses 80 and 82 have sufficient length to accommodate the repositioning of the hydraulic cylinder 78 to the vertical position while still maintaining connection with the hydraulic pump assembly 58. Winch cable 74 has sufficient length to permit the shifting to the vertical position of the frame 68 while still retaining connection between the winch 70 mounted on bracket 60 and the frame. The base support 100 for the compression chamber will rotate into position adjacent the ground. The jacks 52, 90 and 92 can then be adjusted so that the base 101 rests in fixed position on the ground. Appropriate adjustments to the jacks along with liners or adjusting blocks 125 can be provided to compensate for irregularities of the ground surface. The bale press 20 is then in the active position and ready for use. This condition is depicted in FIGS. 3–7 of the drawings. A conventional type of paper board box 116 is positioned in compression chamber 96 through door 104. Alternatively, a bale can be formed without the use of a box. A base bale board 118 is inserted through the open end of container 116 which is in alignment with open end 102 of the compression chamber. The tobacco is loaded from the field directly into compression chamber 96 through open end 102. When a sufficient quantity of tobacco has been loaded, a top bale board 120 is applied to the upper end of container 116. Alternatively, a bale can be formed without the use of bale boards.

Hydraulic cylinder 78 is activated by use of control valve 81, in a conventional manner, so that hydraulic pump assembly 58 drives press head 76 downward into container 116 in engagement with upper bale board 120 compressing the tobacco in bale 108 between the bale boards 120 and 118 in container 116. Door 104 is opened and straps are applied through mating slots 115, 117 and 119 to complete the bale by use of conventional strapping equipment. The press head 76 is raised by operation of the hydraulic pump assembly 58 back into the upper vertical position free from interference with compression chamber 96.

Figure 5:
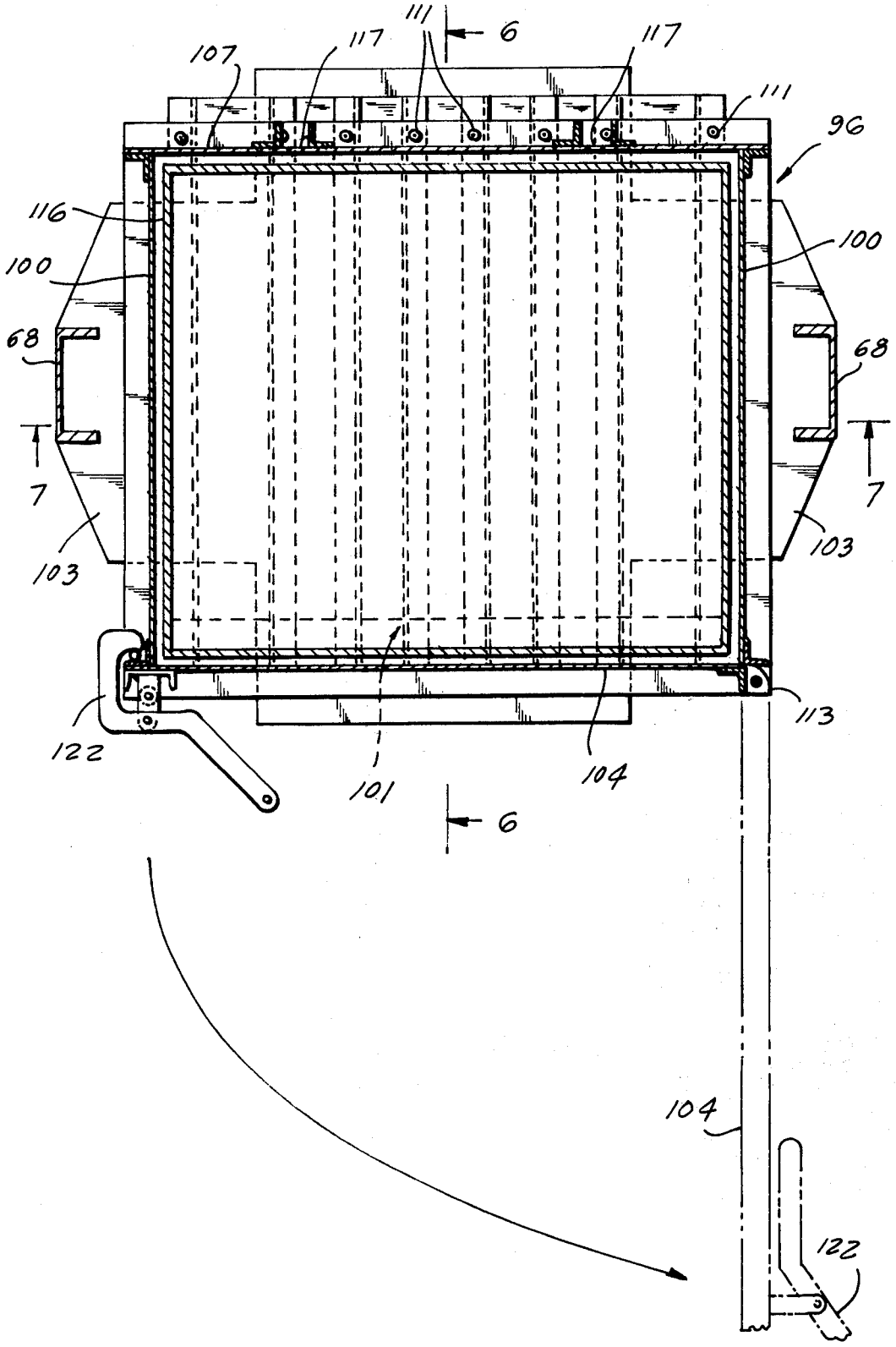
FIG. 5 is a sectional top view thereof taken along the plane of line 5—5 of FIG. 4 with the door of the compression chamber being shown in phantom in open position.
Figure 6:
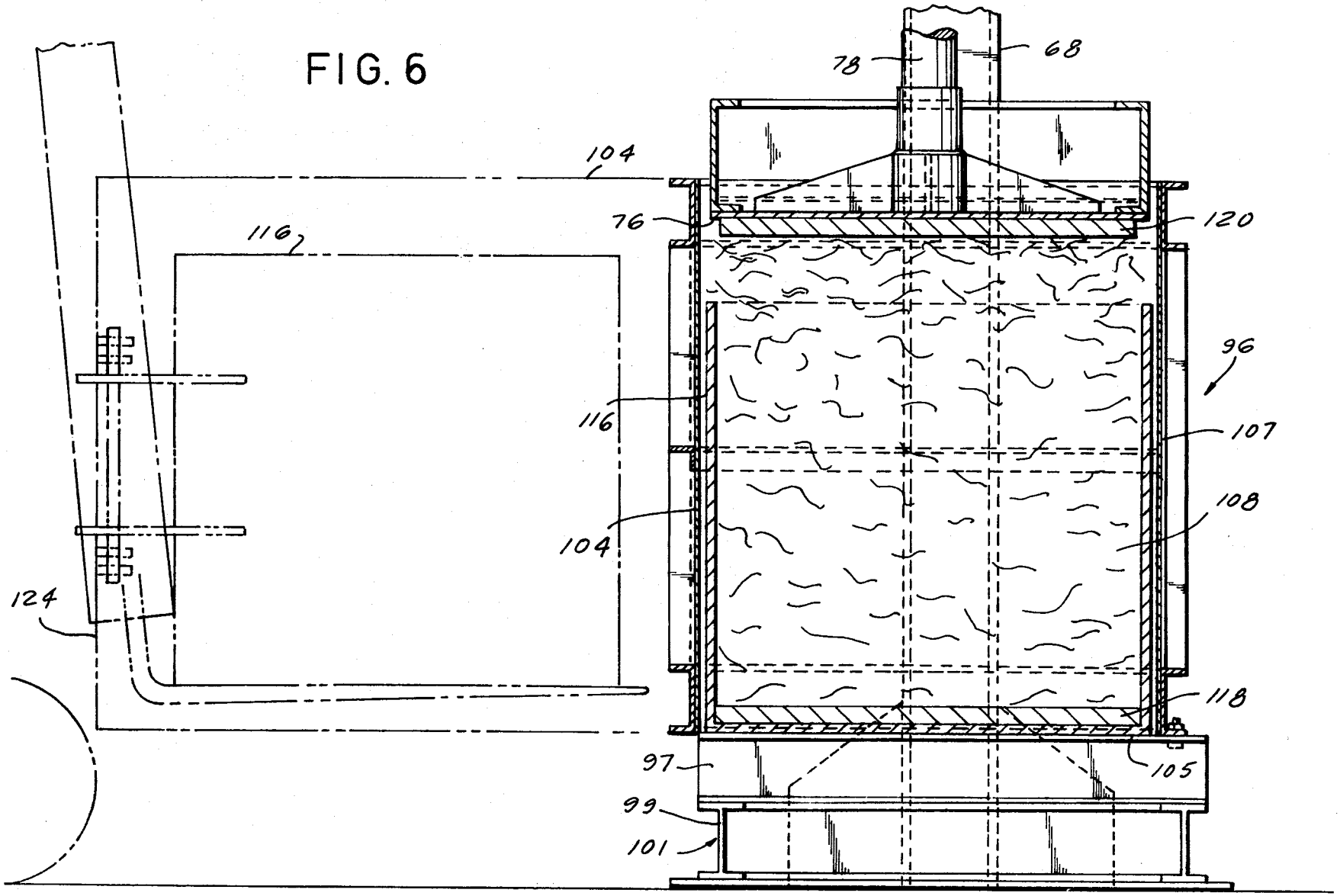
FIG. 6 is a sectional elevation view thereof taken along the plane of line 6—6 of FIG. 5 and showing in phantom a bale being removed through the open door of the compression chamber.

Thereafter, hinged door 104 having been opened, as depicted in phantom in FIG. 5, by operating latch mechanism 122 permits access to the bale 108. The forks of lift device 124 can enter through channels 106 into engagement with the undersurface of container 116 for removal of the bale 108 through the opening provided by open door 104 as depicted in phantom in FIG. 6. The completed bale can then be handled and shipped in an easy and efficient manner. After inserting another paper box 116, door 104 is reclosed with latch mechanism 122 locking the door in the closed position and further bales can be produced in the same manner as described above.

After baling has been completed at a chosen location and it is desired to move bale press 20 to another location, the jacks are extended to raise the rear end of support 22 and winch handle 72 is manually rotated reeling winch cable 74 onto winch 70 and returning frame 68 to the horizontal inactive position. Stop channel 114 is replaced to hold the frame 68 and interconnected structure in horizontal position. The jacks 52, 90 and 92 are then retracted so that the entire structure again rests on wheels 46 whereupon the tractor can move the press to a further location for reshifting into the active position for further baling operations.

Thus the several aforenoted objects and advantages are most effectively attained. Although several somewhat preferred embodiments have been disclosed and described in detail herein, it should be understood that this invention is in no sense limited thereby and its scope is to be determined by that of the appended claims.

I claim:

1. A portable bale press for tobacco and the like comprising; a transportable support, a movable frame pivotally mounted on the support to rotate between a substantially horizontal inactive position on the support and a substantially vertical active position on the support with compression chamber and a press head which is drivable into the compression chamber to form a compressed mass of tobacco in the compression chamber, power means for driving the press head, the frame supporting the compression chamber and the press head being shiftable between an inactive position for transportation of the bale press and an active position where the compression chamber and the press head are in position for compression of tobacco, and releasable holding and shifting means for transferring the frame between positions and holding the frame in the active and inactive positions for tobacco compression and transportation of the bale press respectively, the shifting means including a winch mounted on the support, the winch including a cable mounted to the frame so that rotation of the winch to reel the cable will shift the frame to the inactive position and unreeling of the cable permits the frame to shift to the active position.

2. The invention in accordance with claim 1 wherein the support contains wheels for transportation thereof.

3. The invention in accordance with claim 1 wherein the press head is reciprocally movable when in the vertical active position into and out of the compression chamber.

4. The invention in accordance with claim 1 wherein the power means includes a hydraulic pump on the support and connected to a hydraulic cylinder on the press for driving the press head.

5. The invention in accordance with claim 1 wherein the press head is at one end of the frame in the inactive position and the compression chamber is on the other end of the frame and the weight distribution is such that the other end of the frame is heavier than the one end of the frame, removable stop means to retain the other end of the frame in the inactive position and when removed releases the frame to shift to the active position due to the greater weight at the other end of the frame.

6. The invention in accordance with claim 5 wherein the support includes a peripheral wall formed by two opposing side walls, extending at one end to join and form an apex and spaced at the other end to form an opening, a plurality of spaced transverse supports extending from one side wall to the other side wall, wheels being suspended downward from the peripheral wall and mounted to shafts journaled in a housing suspended from the wall, the movable frame being mounted on at least one of the transverse supports between the opposite sides of the peripheral wall with the frame and connected compression chamber adapted to be rotated into a vertical position through openings between the transverse members and between the peripheral opposing walls so as to extend beneath the walls for resting on the ground beneath the support.

7. The invention in accordance with claim 6 wherein the frame is rotatable on opposing shafts supported by spaced uprights, and the end of the frame containing the press head in inactive position resting on a V-shaped platform, the flat apex of the V-shaped platform extending upward from the support and being rotatable upward and away from the V-shaped platform when the frame is shifted to the active position.

8. The invention in accordance with claim 7 wherein the portion of the support at the end where the compression chamber is located is formed to provide an opening wider than the compression chamber to provide for free rotational movement of the compression chamber between active and inactive positions.

9. The invention in accordance with claim 6 wherein the removable stop means is positioned transversely across the open end peripheral wall and engages with the other end of the frame to retain the frame in the inactive position and when removed releases the frame permitting it to shift within the peripheral wall and into engagement with the ground.

10. The invention in accordance with claim 6 wherein the power means includes a hydraulic pump on the support and connected to a hydraulic cylinder on the press, the hydraulic pump being mounted on transverse members attached to the peripheral wall of the support and extending above the support, connecting hoses between the hydraulic pump and the hydraulic cylinder of the press on the frame to facilitate operation of the press when shifted to the active position, a telescoping drive shaft connecting the hydraulic cylinder to the power take off shaft of a vehicle also used to transport the portable bale press thereby providing for power to the hydraulic pump to operate the portable bale press.

11. The invention in accordance with claim 1 wherein the winch is mounted on a V-shaped upwardly extending projection on the support.

12. The invention in accordance with claim 1 wherein lifting means is on the bale press for lifting the support from the ground surface and supporting the support a predetermined distance above the ground, the lifting means lifting the support sufficiently to permit the portion of the frame containing the compression chamber to be rotated into the vertical position and to rest on the ground in the active position for operation of the bale press.

13. The invention in accordance with claim 12 wherein the lifting means include a plurality of manual jacks on the support and spaced in a predetermined manner to facilitate lifting of the bale press from the ground for shifting to the active position and permitting the bale press to return to the ground when shifting to the inactive position.

14. The invention in accordance with claim 1 wherein the compression chamber including apertures to permit access therein for engagement with and removal of a bale formed in the compression chamber after operation of the bale press.

15. The invention in accordance with claim 1 wherein the support has means thereon for attachment to a vehicle to transport the bale press between locations.

16. The invention in accordance with claim 1 wherein the compression chamber has a base structure and peripheral walls extending therefrom to form a hollow interior open on the end opposite to the base structure for introduction of bale boards, tobacco and the press head therein, a door forming one wall to permit removal of a bale therethrough.

17. The invention in accordance with claim 16 wherein a releasable latch mechanism is on the door to facilitate the opening and closing thereof.

18. The invention in accordance with claim 1 wherein the compression chamber and press head are formed with mating slots to facilitate strapping of a bale formed in the chamber.

* * * * *